United States Patent [19]

Foissner et al.

[11] Patent Number: 4,531,019

[45] Date of Patent: Jul. 23, 1985

[54] INSULATING ARRANGEMENT FOR A CAPACITIVE PROTECTIVE FENCE HAVING A METAL ENCAPSULATED INSULATOR, A MOUNTING DEVICE FOR AN ELECTRIC WIRE AND A DEVICE FOR FASTENING THE INSULATING ARRANGEMENT TO A FENCE POST

[75] Inventors: Herbert Foissner, Wolfratshausen; Herbert Krautwald; Lutz Minke, both of Munich, all of Fed. Rep. of Germany

[73] Assignee: Siemens Aktiengesellschaft, Berlin and Munich, Fed. Rep. of Germany

[21] Appl. No.: 534,521

[22] Filed: Sep. 21, 1983

[30] Foreign Application Priority Data

Oct. 22, 1982 [DE] Fed. Rep. of Germany ..... 3239163

[51] Int. Cl.[3] ..... H01B 17/16; H01B 17/50

[52] U.S. Cl. ..... 174/163 F; 174/40 TD; 174/168; 174/211

[58] Field of Search ..... 174/40 TD, 45 TD, 139, 174/140 R, 140 H, 158 R, 158 F, 160, 161 R, 161 F, 163 R, 163 F, 168, 169, 170, 180, 182, 185, 194, 211; 256/10, 40, 42; 340/564

[56] References Cited

U.S. PATENT DOCUMENTS

| | | | |
|---|---|---|---|
| 6,779 | 10/1849 | Livingston et al. | 174/170 X |
| 45,221 | 11/1864 | Brooks | 174/211 X |
| 524,182 | 8/1894 | McTighe | 174/161 R X |
| 757,418 | 4/1904 | Sachs | 174/160 |
| 923,598 | 6/1909 | Steinberger | 174/160 X |
| 1,065,737 | 6/1913 | Slonecker | 174/139 X |
| 2,454,348 | 11/1948 | Schilling | 174/158 F X |

FOREIGN PATENT DOCUMENTS

| | | | |
|---|---|---|---|
| 211390 | 4/1956 | Australia | 256/10 |
| 833661 | 3/1952 | Fed. Rep. of Germany | 174/164 |
| 916629 | 8/1954 | Fed. Rep. of Germany | 174/140 R |
| 658667 | 10/1951 | United Kingdom | 174/168 |

*Primary Examiner*—Laramie E. Askin

*Attorney, Agent, or Firm*—Karl F. Milde, Jr.

[57] ABSTRACT

An insulator arrangement which may be employed, for example, on a capacitive protective fence comprises three principal elements:

(1) an insulator, made of ceramic or plastic, having at least one ring-shaped recess arranged on its bottom to form a long path for leakage current;

(2) a mounting bracket extending axially downward from the bottom of the insulator which has fastening means on its free end for securing an electric wire; and (3) a metal cup mounted over the insulator to protect it from the environment. A mounting element consisting of two arms forming a U-shaped configuration is arranged on the metal cup to facilitate mounting on a fence post.

4 Claims, 7 Drawing Figures

INSULATING ARRANGEMENT FOR A CAPACITIVE PROTECTIVE FENCE HAVING A METAL ENCAPSULATED INSULATOR, A MOUNTING DEVICE FOR AN ELECTRIC WIRE AND A DEVICE FOR FASTENING THE INSULATING ARRANGEMENT TO A FENCE POST

BACKGROUND OF THE INVENTION

The invention is related to an insulator on the bottom of which, axially centered and concentric with a mounting bracket, is at least one ring-shaped recess, which forms a path for the insulation leakage current. On the outside of the insulator is an electrically conducting metal cup.

Insulators with an electrically conducting metal cup on the outside, which are installed in capacitive protective fences and are exposed to extreme environmental conditions, must possess corrosion resistant electrically conducting surfaces. Protective fences in the vicinity of the ocean or in desert regions are exposed to an extremely aggressive climate and extraordinarily strong stresses, because sand, air, moisture and salt attack the surfaces of the insulator, as well as the mounting and fastening devices used with the insulators. Consequently, existing insulators often fail in exposed installations due to the corrosive effects of environmental factors.

SUMMARY OF THE INVENTION

The object of the invention is to provide an insulator with an extremely corrosion-resistant metal cup.

It is a further object of the invention to provide fastening elements for mounting the insulator on the capacitive protective fence which are both simply and efficiently fabricated from corrosion-resistant material.

These objects, as well as further objects which will become apparent from the discussion that follows, are achieved, according to the invention, by providing an insulating arrangement comprising three elements:

(1) An insulator, made of ceramic or plastic, having at least one ring-shaped recess arranged on its bottom to form a long path for leakage current.

(2) A mounting bracket extending axially downward from the bottom of the insulator. This mounting bracket has a fastening means on its free end for securing an electric wire.

(3) A metal cup mounted over the insulator to protect it from the environment. A mounting element consisting of two arms, which form a U shaped configuration, is arranged on the metal cup to facilitate fastening the insulator arrangement to a fencepost.

The metal cup can advantageously be drawn, or stamped and folded, from rust-free stainless steel plate and then inverted over the insulator; or the insulator can be fitted into the metal cup. In this process, it is particularly desirable to fabricate the fastening flange that is used to install the insulator on the post of the capacitive protective fence at the same time that the metal cup is manufactured. The mounting bracket that is introduced axially at the bottom of the insulator is also manufactured of rust-free corrosion-resistant stainless steel and equipped at a free end with a fastening device for the electrode wire. The fastening device can be designed in several different ways, so that it merely supports the electrode wire, anchors it securely or stretches it.

It is desirable to have the metal cup adapted to the form of the insulator; the preferred form is a parallelepiped that is open at the bottom. This is especially easy to manufacture by stamping and bending or folding from steel plate. The fastening flange can be stamped out in the same operation and bent into two arms forming a U shaped configuration. Next to each of the arms is a perforation in the metal cup that covers the insulator. Through these perforations, it is possible to draw a hose clamp. This makes it possible to fasten the insulator, that is the subject of the invention, in a simple manner to the grounded fencepost with an electrical conductor, without additional grounding elements being required.

In another embodiment of the invention, the mounting bracket of the insulator is U-shaped and preferably provided with at least one roughly circular spring winding. This eliminates the need for an additional tension spring which would otherwise be needed for changes in the length of the stretched electrode wire due to fluctuations in temperature. This is very advantageous because, for extremely unfavorable climatic conditions, there is no readily available tension spring that can be used. Instead, a special exceptionally corrosion-resistant tension spring would have to be obtained. An additional advantage results from the fact that with the elimination of the tension spring, the weight load of the electrode wire is lower, and the oscillations of the electrode wire are thereby reduced. Furthermore, the capacitive characteristics of the protective fence are improved by the direct connection of the wire to the insulator, because there is no increase in the surface area of the electrode wire due to the tension spring.

A novel, yet simple and practical way of manufacturing a fastening device for the electrode wire at the free end of the mounting bracket is to introduce diametrically a hole through which the electrode wire is drawn and wound several times around the free end of the mounting bracket.

A more sophisticated design for the fastening device consists of a wire tension device placed directly on the free end of the mounting bracket. This wire tension device replaces the conventional galvanized tension lock, which is disadvantageous because of its lack of resistance to corrosion. This also further reduces the weight load of the electrode wire. It is desirable for the wire tension device to have a wire-winding drum and crank, with which the wire can be tightened. The crank can then be removed once the wire is tightened. The drum is held in place with a cotter pin which is inserted through the drum and a hole in the mounting bracket.

Other features and advantages of the present invention will become apparent from the following detailed description and from the claims.

For a full understanding of the present invention, reference should now be made to the following detailed description and to the accompanying drawings.

DETAILED DESCRIPTION

Figure 1:
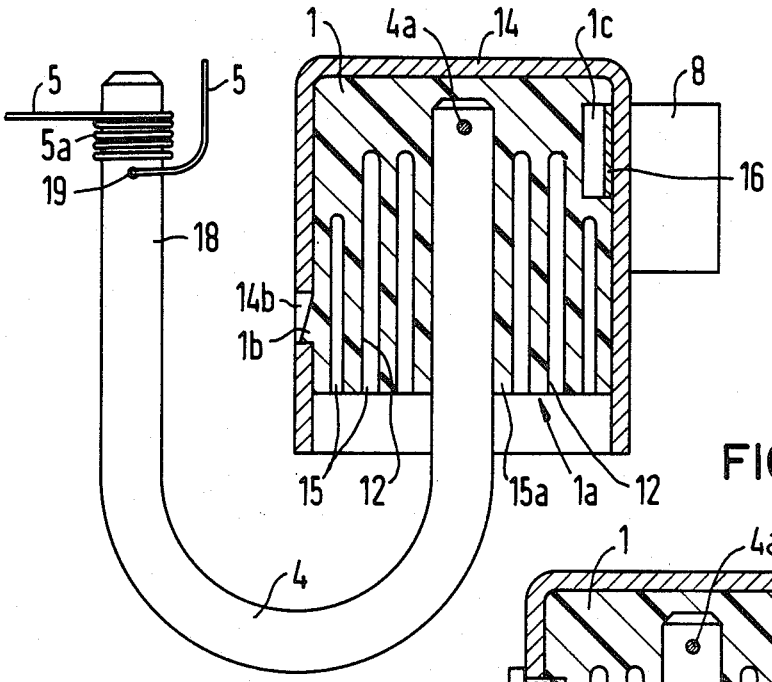
FIG. 1 is a cross-sectional view of an insulator, a metal cup and a U-shaped mounting bracket.

Referring to FIG. 1, insulator 1 is shown in cross-section with U-shaped mounting bracket 4. Insulator 1 may be made of ceramic or plastic. It is desirable for it to be in the shape of a parallelepiped. The U-shaped mounting bracket is inserted into the body of the insulator through the center of the bottom of the insulator. Mounting bracket 4 can be further anchored in the body of the insulator by means of crosspiece 4*a* (shown in more detail in FIG. 3). Crosspiece 4*a* is inserted through a hole in mounting bracket 4 and therefore prevents the insulator from being twisted. Metal cup 14 is preferably in the form of a parallelepiped that is open at the bottom, and into which the body of insulator 1 is introduced. In order to hold metal cup 14 more securely on the body on the insulator, window-shaped recess 14*b*, provided on one side of metal cup 14, and projection 1*b* which is molded as part of insulator 1, are engaged. On the bottom 1*a* of the insulator are several recesses 15 arranged concentrically around mounting bracket 4. Ribs 15*a*, formed by these recesses, constitute a very long leakage current path 12 between mounting bracket 4 and metal cup 14 of insulator 1. Free end 18 of U-shaped mounting bracket 4 has a hole 19 through which electrode wire 5 can be passed. The electrode wire is wound in several turns 5*a* around free end 18 of mounting bracket 4. It is then passed through hole 19 and may, for example, be carried to a distributor box (not shown) which is mounted on the post above the insulator. Electrode wire 5 can then be tightened and continued to the next insulator and from there to the distributor box. On one side of metal cup 14 is fabricated a fastening flange 8, consisting of two arms forming a U-shaped configuration (shown in FIGS. 4 and 6).

Figure 2:
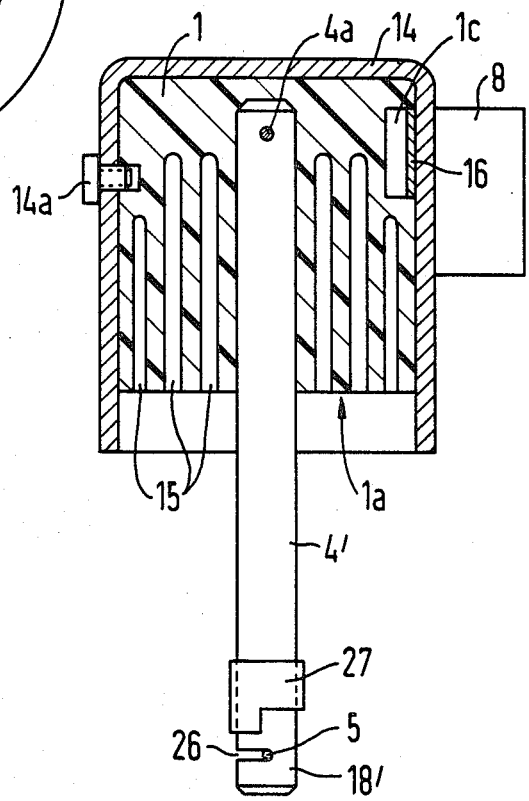
FIG. 2 is a cross-sectional view of an insulator and a metal cup with a short perpendicular mounting bracket.

FIG. 2 shows another embodiment of the invention. In this embodiment mounting bracket 4 has been replaced by mounting bracket on shaft 4′ which has been inserted into the body of the insulator in the same manner as bracket 4. Mounting shaft 4′ is short and it has a slit 26 at its free end 18′. Slit 26, which is perpendicular to the longitudinal axis of mounting shaft 4′, extends at least to the center of mounting shaft 4′. Electrode wire 5 is placed in slit 26, where it is free to move. However, to prevent wire 5 from springing out of the slit, collar 27, which can be moved along mounting shaft 4′, is pushed downward over slit 26 after insertion of the wire. After the collar has been moved over the slit, wire 5 is still free to move along its length due to changes in length that result from fluctuations in temperature. The body of insulator 1 also has concentrically arranged ring-shaped recesses on its underside 1*a*. Fastening flange 8 can be seen on one side of the metal cup 14. In the immediate vicinity of fastening flange 8, the body of insulator 1 has a recess 1*c*. Through recess 1*c* and perforations formed at locations 9 (shown in FIGS. 4 and 6) in metal cup 14, hose clamp 16 (shown in FIGS. 3 to 6) can be inserted, to fasten insulator 1 to post 6. As an alternative means of fastening insulator 1 to metal cup 14, window 14*b* and projection 1*b* ( shown in FIG. 1) can be replaced with screw 14*a* which can easily be turned through metal cup 14 into a hole in insulator 1.

Figure 3:
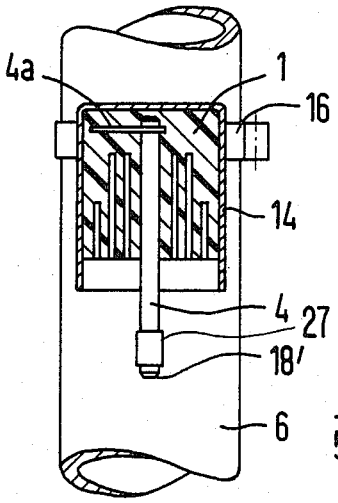
FIG. 3 is a cross-sectional view of the insulator and metal cup of FIG. 2 mounted on a fencepost.
Figure 4:
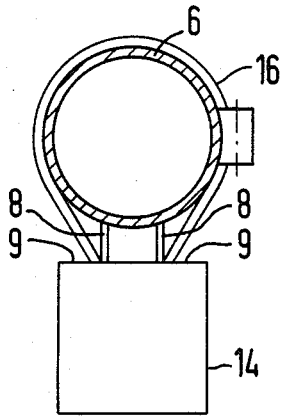
FIG. 4 is a top view of the insulator, a metal cup and fence post FIG. 3, the fence post being shown in cross section.

In FIG. 3, insulator 1 of FIG. 2 is shown mounted on fence-post 6. As already described, insulator 1 is fastened with hose clamp 16 to post 6. This can be seen more clearly in FIG. 4 which gives a top view of insulator 1 attached to post 6. Insulator 1 is kept at a specified distance from post 6 by means of the two arms of fastening flange 8. Hose clamp 16, which is introduced through perforations at locations 9 in metal cup 14 and through recess 1*c* in the body of insulator 1, is wound around post 6 and fastened in a conventional manner with a worm gear.

Figure 5:
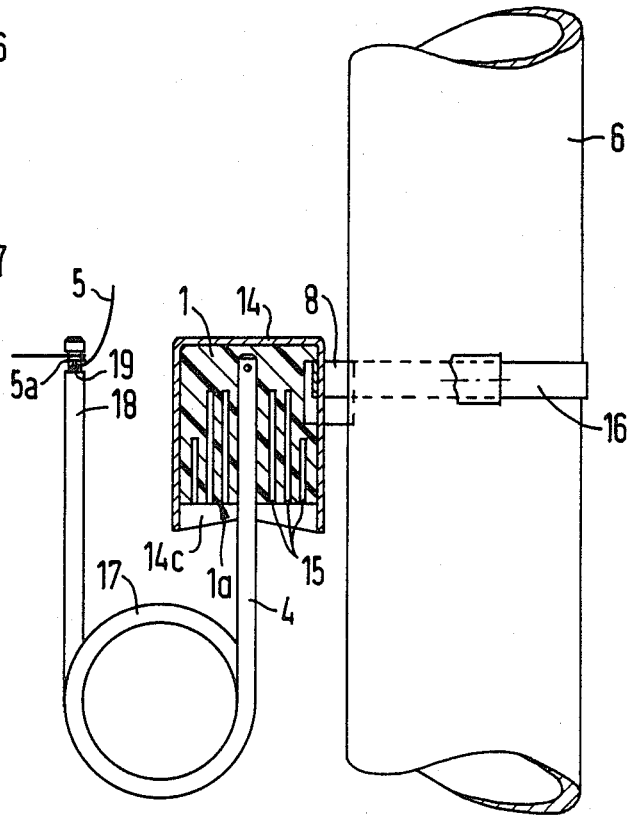
FIG. 5 is a cross-sectional view of an insulator, a metal cup with a U-shaped mounting bracket, and a spring winding, shown attached to a fence post.
Figure 6:
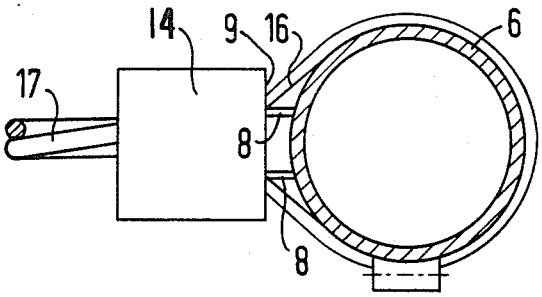
FIG. 6 is a top view of the insulator arrangement of FIG. 5 with the fencepost shown in cross section.

Referring to FIG. 5, another embodiment of the invention is shown in which insulator 1 has attached to it U-shaped mounting bracket 4, which includes circular spring winding 17. Free end 18 of mounting bracket 4 corresponds to FIG. 1 with regard to the fastening of electrode wire 5. Insulator 1 is fastened with hose clamp 16 to post 6. Metal cup 14 is longer than the body of insulator 1, so that bottom 1*a* of the insulator is better protected against the effects of the weather by the projecting metal cup. In this area, the metal cup has roof-shaped projections 14*c* on two opposite sides, so that in the case of the insulator shown in FIG. 3, water cannot drop directly onto the electrode wire when it is raining. A top view of this arrangement is shown in FIG. 6.

Figure 7:
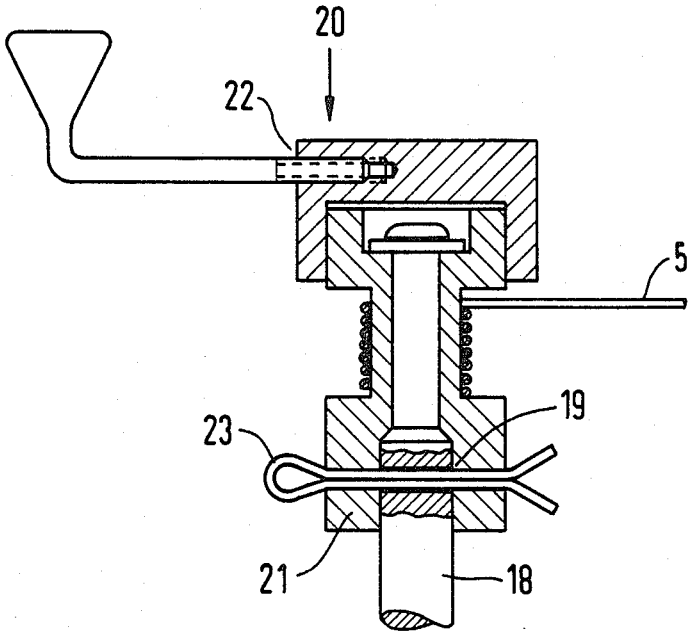
FIG. 7 is a cross-sectional view of a wire tension device located on the free end of the mounting bracket.

Referring to FIG. 7, the wire tension device is shown in detail. Free end 18 of the U-shaped mounting bracket has hole 19, and wire tension device 20 placed on the free end. It consists, in the embodiment shown, of drum 21, which is used to wind up and tighten electrode wire 5. Removable assembly crank 22 is used to tighten wire 5. Drum 21 is held in place on free end 18 of the mounting bracket by means of cotter pin 23.

There has thus been shown and described a novel insulator for a capacitive protective fence which fulfills all the objects and advantages sought. Many changes, modifications, variations and other uses and applications of the subject invention will, however, become apparent to those skilled in the art after considering this specification which discloses embodiments thereof. All such changes, modifications, variations and other uses and applications which do not depart from the spirit and scope of the invention are deemed to be covered by the invention which is limited only by the claims which follow.

What is claimed is:

1. An insulating arrangement comprising, in combination:

(a) an insulator having at least one ring-shaped recess arranged on the bottom thereof forming a long path for leakage current, (b) a mounting bracket extending axially downward from said bottom of said insulator, concentrically with said ring-shaped recess, said mounting bracket having fastening means on its free end for securing an electric wire; and (c) a metal cup mounted over said insulator on which is arranged a mounting flange having two arms forming a U shaped configuration, said metal cup having a perforation adjacent each of said arms for receiving a clamping band for fastening the insulating arrangement to a post.

2. The insulator of claim 1, wherein the metal cup is made of rust-free stainless steel.

3. An insulating arrangement comprising, in combination:

(a) an insulator having at least one ring-shaped recess arranged on the bottom thereof forming a long path for leakage current;

(b) a mounting bracket extending axially downward from said bottom of said insulator, concentrically with said ring-shaped recess, said mounting bracket being U shaped and being bent into a circular loop to form a spring coil, said mounting bracket further having fastening means on its free end for securing an electric wire; and (c) a metal cup mounted over said insulator to protect the insulator from the environment.

4. An insulating arrangement comprising, in combination:

(a) an insulator having at least one ring-shaped recess arranged on the bottom thereof forming a long path for leakage current;

(b) a mounting bracket extending axially downward from said bottom of said insulator, concentrically with said ring-shaped recess, said mounting bracket having fastening means on its free end for securing an electric wire, said fastening means comprising a wire tension device having a wire-winding drum with a removable crank and a cotter pin, the cotter pin being insertable through the drum and through a hole in the mounting bracket; and (c) a metal cup mounted over said insulator to protect the insulator from the environment.

* * * * *